US008870448B2

(12) United States Patent
Bianco et al.

(10) Patent No.: US 8,870,448 B2
(45) Date of Patent: Oct. 28, 2014

(54) BRACELET WITH COMFORT PAD

(75) Inventors: Daniele-Antonio Bianco, Carouge (CH); Benjamin Celant, Arenthon (FR); Adrien Catheline, Valleiry (FR); Yannick Droux, Massongy (FR)

(73) Assignee: Rolex S.A., Geneva (CH)

( * ) Notice: Subject to any disclaimer, the term of this patent is extended or adjusted under 35 U.S.C. 154(b) by 116 days.

(21) Appl. No.: 13/430,883

(22) Filed: Mar. 27, 2012

(65) Prior Publication Data

US 2012/0250471 A1 Oct. 4, 2012

(30) Foreign Application Priority Data

Apr. 1, 2011 (EP) ..... 11405239

(51) Int. Cl.
*G04B 37/00* (2006.01)
*A44C 5/00* (2006.01)
*A44C 5/14* (2006.01)

(52) U.S. Cl.
CPC .... *A44C 5/00* (2013.01); *A44C 5/14* (2013.01)
USPC ..... 368/282; 224/174

(58) Field of Classification Search
USPC ..... 368/282, 286, 276; 63/3, 11; 224/164, 224/171, 175
See application file for complete search history.

(56) References Cited

U.S. PATENT DOCUMENTS

| | | | | | |
|---|---|---|---|---|---|
| 2,184,060 | A | * | 12/1939 | Singer | 224/171 |
| 2,649,230 | A | * | 8/1953 | Thompson | 368/286 |
| 2,745,580 | A | * | 5/1956 | Ward | 368/286 |
| 2,895,658 | A | * | 7/1959 | Dzus | 224/171 |
| 3,375,958 | A | * | 4/1968 | Cooper | 224/171 |
| 3,584,455 | A | * | 6/1971 | Sion | 368/283 |
| 3,610,488 | A | * | 10/1971 | Tracy | 224/171 |
| 4,060,185 | A | * | 11/1977 | Kuroda | 224/176 |
| 4,821,532 | A | * | 4/1989 | Jaques et al. | 63/3 |
| 5,442,602 | A | * | 8/1995 | Hirai et al. | 368/286 |
| 6,390,667 | B2 | * | 5/2002 | Simonis | 368/282 |
| 7,654,732 | B2 | * | 2/2010 | Burton et al. | 368/282 |
| 2009/0135681 | A1 | * | 5/2009 | Lawson | 368/282 |

FOREIGN PATENT DOCUMENTS

| | | | | |
|---|---|---|---|---|
| EP | 2 098 131 | A2 | | 9/2009 |
| JP | 9-316718 | A | | 12/1997 |
| JP | 2002-262910 | A | | 9/2002 |
| JP | 2002262910 | A | * | 9/2002 |

OTHER PUBLICATIONS

European Search Report (ESR) of priority application EP11 40 5239, mailing date Aug. 31, 2011.

* cited by examiner

*Primary Examiner* — Amy Cohen Johnson
*Assistant Examiner* — Daniel Wicklund
(74) *Attorney, Agent, or Firm* — Westerman, Hattori, Daniels & Adrian, LLP

(57) ABSTRACT

A bracelet strand (1) for a wristwatch has a first end (2) suitable for a connection to a watchcase (29). A comfort pad (10) is arranged on the inner surface of the bracelet strand (1) towards this first end (2). This comfort pad (10) has a longitudinal opening (15).

15 Claims, 3 Drawing Sheets

BRACELET WITH COMFORT PAD

INTRODUCTION

The present invention relates to a bracelet strand for a wristwatch. It likewise relates to a bracelet and to a wristwatch as such, which comprise such bracelet strands.

PRIOR ART

A flexible bracelet made from leather or polymeric (elastomeric, thermoplastic, thermoplastic/elastomeric) material is often thicker in the zone where it connects to the watchcase, for esthetic reasons and/or in order to offer sufficient space to incorporate mechanical fastening elements. Such a solution thus has the drawback of making the bracelet strand stiffer in this zone, which may be awkward for the wearer thereof and cause the latter a sensation of discomfort.

There are, however, various ways in which to wear a wristwatch: some prefer a loose fit whereas others prefer a tighter fit. This choice of fit is determined by adjusting the length of the strands when the bracelet is closed on the arm by a conventional clasp. This initial adjustment of the bracelet can be modified, for example when taking part in a sport such as underwater diving, which is accompanied by a significant reduction in wrist size owing to the pressures exerted and, more particularly, if the wristwatch is worn over a diving suit. There is then a risk of the wearer being left with a bracelet that is too loose and a watch that does not stay in place and moves about on the arm. Another case in point is when the wrist expands when the weather is warm, which may lead to discomfort.

In order to avoid such a phenomenon, it is useful to have a stable wristwatch, i.e. one adapted in order to provide optimum comfort in all initial adjustment configurations of the bracelet and under all conditions of use, avoiding, in particular, the exertion of uncomfortable pressure on the wrist or significant movement of the watch over the arm.

In order to respond to these constraints, document JP2002262910 proposes to produce a transverse opening in the thickness of the bracelet strand around the zone where the bracelet strand is fastened to the watchcase, to result in a damping of the stresses exerted by the bracelet on the wearer's arm. This solution is therefore embodied by a bracelet strand that has the same profile over the entire transverse section of the strand, which comprises, in particular, an opening over this entire width, surmounted by a continuous surface in contact with the wearer's arm. In practice, this solution proves to be insufficiently effective for reducing the pressures exerted on the arm by the bracelet. Furthermore, it renders the bracelet difficult to clean and there is a high risk that dirt will collect, particularly at this transverse opening. Moreover, said opening is readily visible and does nothing to enhance the overall esthetic appearance of the bracelet. Lastly, this solution is unstable and does not allow automatic adaptation of the fit of the bracelet on the arm, for example when diving.

Another prior-art solution involves giving a bracelet strand a part which is in the form of a concertina, which part is thus able to open out or close up automatically in order to adapt to variations in wrist size and, in particular, provides a sufficiently tight fit when diving. In practice, such a solution requires significant initial tightening of the bracelet, which tends to stretch the concertina part, in order then to obtain automatic closing-up thereof when diving. This initial tightening gives rise to discomfort on the arm, and this solution is an insufficient response to comfort requirements for a bracelet.

There is thus a need for a solution for a bracelet strand that makes it possible to respond to the above-mentioned constraints without including all or some of the drawbacks of prior-art solutions.

More precisely, a first object of the invention consists in finding a solution in the form of a bracelet strand that makes it possible to achieve optimum comfort over a wide range of adjustment and use of the wristwatch.

A second object of the invention consists in finding a solution involving a bracelet strand adapted to the variation in wrist size during use thereof, in particular for underwater diving.

Furthermore, the invention naturally seeks a solution involving a bracelet strand that is easy to clean, esthetically pleasing, easy to manufacture, reliable and durable.

BRIEF DESCRIPTION OF THE INVENTION

To that end, the invention comprises a bracelet strand for a wristwatch, comprising a first end suitable for a connection to a watchcase, which comprises a comfort pad arranged on the inner surface thereof towards this first end and wherein this comfort pad comprises a longitudinal opening.

The invention is defined in precise terms by the claims.

BRIEF DESCRIPTION OF THE FIGURES

These objects, features and advantages of the present invention will be set forth in detail in the following description of particular embodiments given by way of non-limiting example in connection with the attached figures, among which.

In the remainder of the description, the following terms will be used: "longitudinal direction" will mean the direction along the length of a bracelet strand, extending from a zone of fastening to a watchcase towards a zone of fastening to a bracelet clasp; "transverse direction" will mean the direction perpendicular to the longitudinal direction in the plane of the bracelet strand, corresponding to the axis of the wrist; and "vertical direction" will mean the direction perpendicular to the bracelet strand (or perpendicular to the skin surface), perpendicular to the longitudinal and transverse directions, oriented toward the inside from the inside surface of the bracelet. Furthermore, "inside surface" will mean the surface of the bracelet strand that is oriented toward the wearer's arm and, conversely, "outside surface" will mean the opposite surface, which is visible from the outside when the bracelet is worn.

FIGS. 1 to 5 illustrate a first embodiment of the invention.

Figure 1:
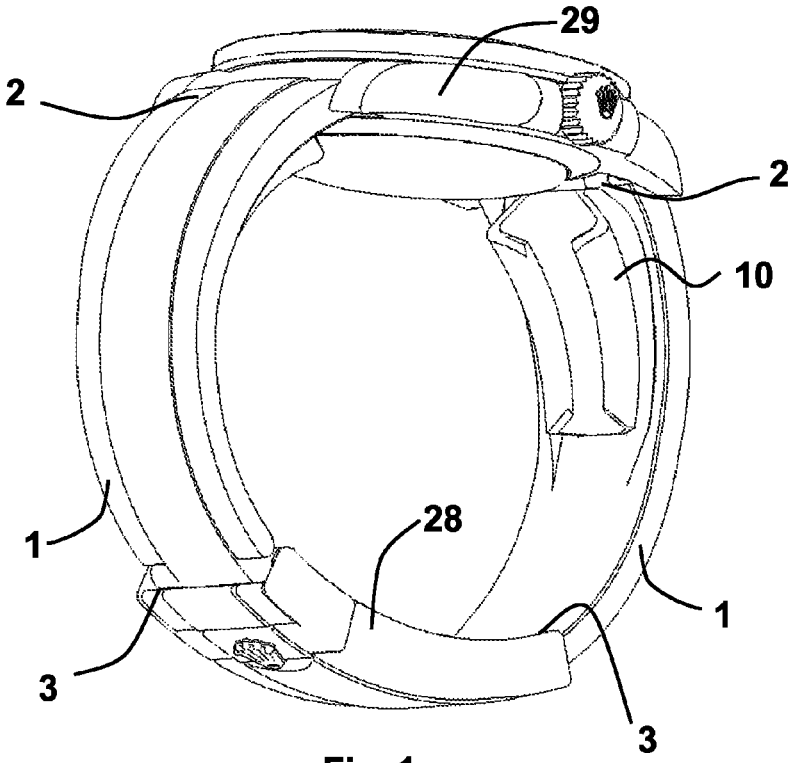
FIG. 1 shows a perspective view of a wristwatch provided with a bracelet according to a first embodiment of the invention.

As may be seen, in particular, in FIG. 1, the wristwatch according to this embodiment comprises a bracelet that comprises two strands 1, a first end 2 of which is fastened to the watchcase 29, for example by means of an articulation pin allowing automatic natural orientation of the strands 1 on the wrist. It is possible for there to be no articulation but a means of fastening that matches the radius of the watchcase. The second end 3 of the strands 1 serves to link those strands together in order to close and tighten the bracelet around the wearer's arm, by means of a clasp 28 which may, for example, have the form of a folding buckle.

Figure 2:
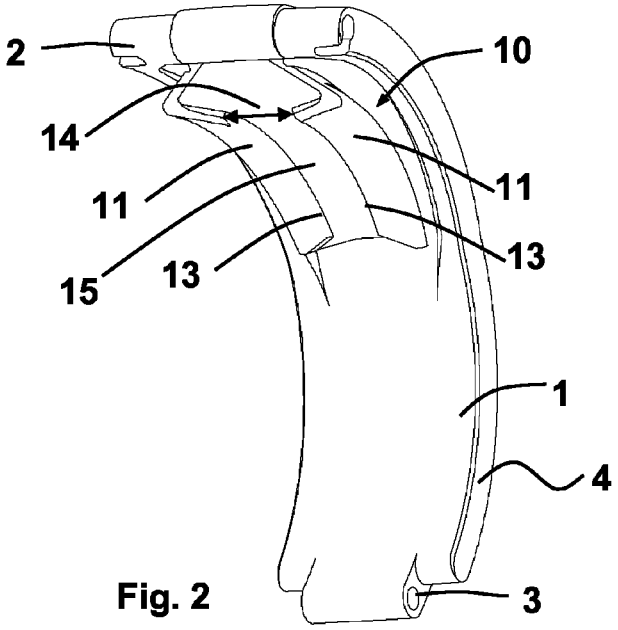
FIG. 2 shows a perspective view of the bracelet according to the first embodiment of the invention.

As may be seen, more particularly, in FIG. 2, each strand 1 of the bracelet comprises a comfort pad 10 on the inside surface thereof in the zone thereof located close to its end 2 provided for connecting to a watchcase.

According to this embodiment, this comfort pad 10 comprises two distinct elastic parts 11 positioned symmetrically about the longitudinal axis of the strand 1. These two elastic portions 11 extend from the inside surface of the strand in a vertical direction as far as upper ends 13, separated from one another by a distance 14, while providing access toward a central opening 15. This central opening 15 has the form of a volume of air delimited at the bottom by the inside surface of the strand 1, laterally by the two elastic portions 11, and open toward the outside, at the top, via the space between the two upper ends 13 of each elastic portion 11. This central opening 15, and also the elastic portions 11, extend in the longitudinal direction in a continuous manner over the entire length of the comfort pad 10.

Figure 3:
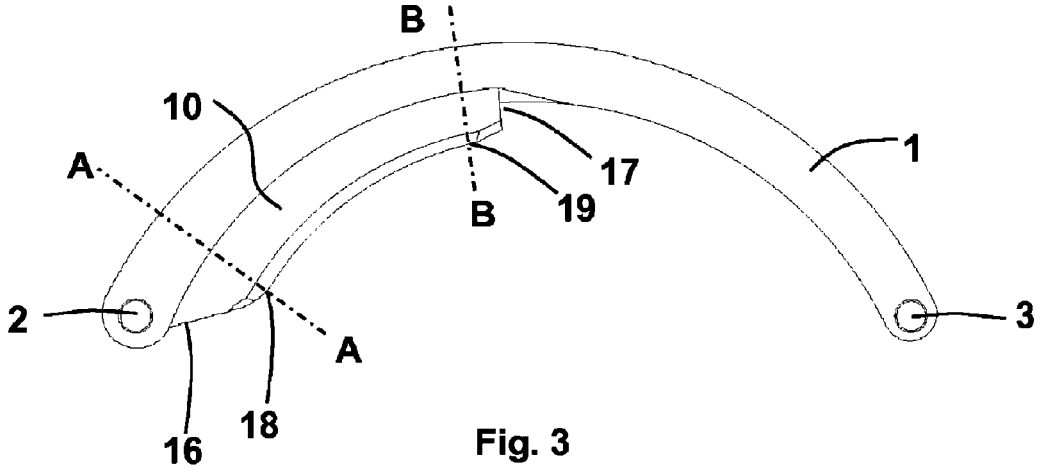
FIG. 3 shows a side view of a bracelet strand according to the first embodiment of the present invention.

As shown in FIG. 3, the comfort pad 10 extends over a sufficient length to achieve satisfactory comfort on the wearer's wrist, between a first end 16 close to the end 2 of the strand provided for connection to a watchcase as far as a second end 17. This length is preferably greater than or equal to one fourth of the length of the strand 1. In this embodiment, this length represents slightly less than half the length of the strand 1. It is preferably less than half of this length but may extend over the entire length of the strand.

Figure 4:
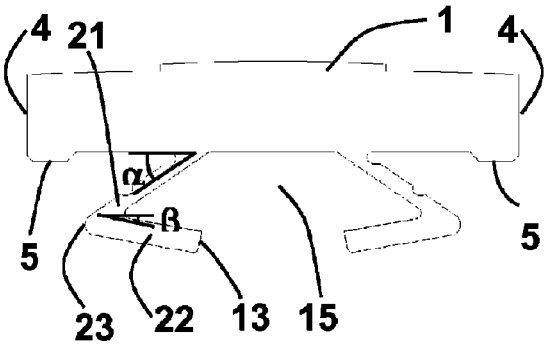
FIG. 4 shows a sectional view in a first transverse plane A-A of the bracelet strand according to the first embodiment of the present invention.
Figure 5:
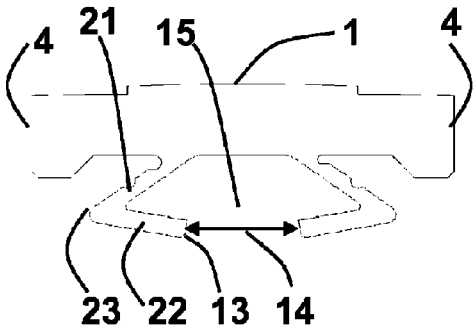
FIG. 5 shows a sectional view in a second transverse plane B-B of the bracelet strand according to the first embodiment of the present invention.
Figure 6:
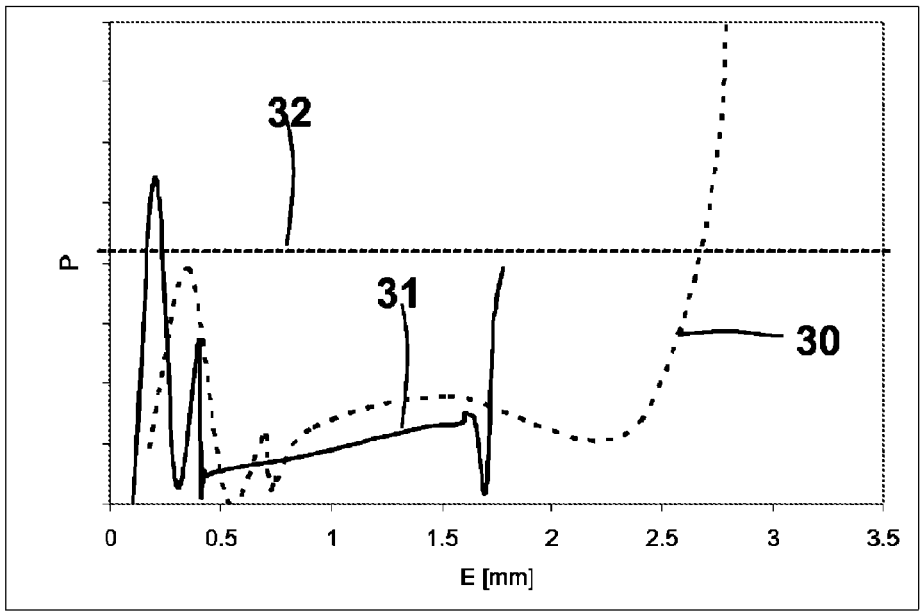
FIG. 6 illustrates the stresses P exerted on the arm as a function of compression E of the bracelet strand according to the first embodiment of the present invention.

The way in which this comfort pad operates will now be explained, with reference to FIGS. 4 to 6. Its form is designed so that the pressure it exerts on all points of the wrist remains below a threshold that can be tolerated by the wearer, over a wide range of tightening of the bracelet. FIGS. 4 and 5 thus show two transverse sections of the comfort pad 10 according, respectively, to sections in two different transverse planes A-A, B-B, which are shown in FIG. 3. FIG. 6 shows the curves 30, 31 of pressure P suffered by the wrist for different levels of tightening the bracelet given by the compression distance E of the pad, respectively in each zone 18, 19 in contact with the wrist, corresponding to the two sectional planes A-A, B-B mentioned above. The threshold 32 represents the maximum stress P beyond which the level of comfort is no longer acceptable for prolonged wearing of the bracelet. It may readily be seen that the comfort pad 10 thus makes it possible to achieve the ideal level of comfort sought by the bracelet wearer under all conditions of tightening of the bracelet. The one-off maximum, at the start of compression of the comfort pad, is very probably an artifact of digital simulation and is not found in wearing tests. The comfort pad 10 thus completely fulfills its comfort function.

FIGS. 4 and 5 also make it possible to note that the section of each elastic portion 11 has an inclined V form, comprising two straight branches 21, 22. The lower branch 21 of the V extends from the inside surface of the strand toward the lateral border of the strand, with a slight inclination of angle $\alpha$ relative to this surface. The second, upper branch 22 of the V then extends from the point 23 of the V toward the center of the strand, as far as the upper end 13, at an angle $\beta$ relative to the plane of the strand. The two angles of inclination $\alpha$, $\beta$ of the two branches 21, 22 of the comfort pad 10 allow a deflection of the order of 2.5 mm at the end 16 of the comfort pad 10 positioned on the side of the end 2 thereof, for a connection to a watchcase 29. This deflection may differ along the length of the comfort pad. It makes it possible to respond to different levels of tightening envisaged for the bracelet and to ensure stability of the bracelet, even in the case of a loose fit and diving.

Moreover, the inclined V form of each elastic portion 11 of the comfort pad 10 allows the upper branch 22 of the pad rapidly to become a surface substantially parallel to the inside surface of the strand, and more precisely capable of matching the surface of the wearer's arm, thereby distributing the contact pressure force over the entire surface thereof and avoiding the hardness that would be caused by the same pressure being exerted over a smaller surface. So this contact surface of the comfort pad increases little with compression thereof and comfort is maintained independently of pad compression.

The point 23 of the V of the elastic portions 11 of the comfort pad, which is oriented toward the lateral borders 4 of the strand, remains distant from these lateral borders 4, i.e. the strand 1 extends beyond the elastic portions 11. This enables the comfort pad 10 to be made discreet and non-obvious, which is advantageous in terms of the overall esthetic appearance of the bracelet. This effect is rendered possible by the fact that the comfort pad 10 extends in the longitudinal direction, which enables it to remain distant from the lateral borders 4 of each strand. In order to further enhance this effect, thicker lateral edges 5 are provided on the inside surface of the strand 1 at the lateral borders 4 thereof, beyond the elastic portions 11, in order to conceal the comfort pad 10.

Naturally, the elastic portions 11 may have V forms different than those illustrated. Advantageously, the angles $\alpha$, $\beta$, measured at rest, may comply with the following conditions:

$$5<\alpha<45 \text{ and } 0<\beta<45$$

In a variant embodiment, these elastic portions may have a section of different form, for example that of a U, or have rounded branches, or comprise three branches or more. When at least one of the branches has a rounded form, the values given above for the angles apply to the angle between a tangent to the branch and the inside surface of the strand. In particular, the initial inclination of these branches advantageously corresponds to the above values and the angle of the tangent in the initial part of these branches is thus particularly taken into account.

This geometry of the elastic portions 11 may, furthermore, vary in the longitudinal direction of the comfort pad 10. For example, the deflection may be reduced toward the end 2 closest to the watchcase 29. Incidentally, another solution for reducing this deflection consists in increasing the thickness of the strand 1 at the positioning thereof toward the watchcase 29. However, the concept described above is advantageous in that this increase in the thickness of the strand at the end 2 thereof toward a watchcase 29 is not mandatory in order to achieve the required level of comfort. According to a variant embodiment that is not shown, each elastic portion 11 has interruptions 20 arranged at a defined pitch in the longitudinal direction in order to enhance the overall flexibility of the strand. According to a further variant embodiment that is not shown, the comfort pad may comprise more than two elastic portions 11.

Furthermore, the comfort pad may be made from any elastic material, such as an elastomer (rubber), or any plastic material (such as a thermoplastic/elastomer, generally one chosen so as to have a low level of hardness). According to an advantageous embodiment, the comfort pad is made as a single piece together with the strand, by molding for example, which makes it possible to produce a one-piece bracelet.

Naturally, a person skilled in the art may seek advantageous compromises among all the factors mentioned above for the comfort pad in order to define embodiments of the invention dependent on particular requirements.

Lastly, the longitudinal opening 15 of the comfort pad has been presented as a simple air-filled opening. According to a variant embodiment, this longitudinal opening is filled with a special shock-absorbing material, for example in the form of gel- or air-filled cells.

Finally, the solution described above is well able to achieve the objectives sought and offers the following advantages:

- it makes it possible to achieve a satisfactory level of comfort and better stability of the watch in the case of a loose fit and a tight fit of a bracelet, with good control of contact surfaces and the pressure thereof that is exerted on the arm, while fulfilling a shock-absorbing function in the event of impact; measurements have thus shown that the presence of a pad reduces angular deflection by a factor of 4 within the context of a loose fit (from 28.8° to 8.5°);
- it allows automatic adaptation of the bracelet to variations in wrist size, for example when taking part in underwater diving, compensating for a reduction in wrist size of 15 mm without loss of contact between the pads and the wrist in tests performed, thereby enabling the bracelet to remain in contact with the wearer's wrist over the entire surface thereof in a significant range of lengths, without the need to modify the adjustment of the level of tightening of the bracelet. This function is sometimes also referred to as "taking up play";
- it makes it possible to achieve an advantageous esthetic appearance owing to the discreet nature of the pad;
- it allows easy cleaning owing to the way in which it opens up, simply by, optionally, separating the two lateral elastic portions 11; and
- it likewise facilitates ventilation to the wrist owing to the presence of an opening.

Naturally, the invention is not limited to the embodiments described.

According to a second embodiment, the longitudinal opening of the comfort pad 10 is closed on the upper surface thereof and comprises, optionally, an opening toward its ends 16, 17 on the watchcase side and/or on the opposite side.

Figure 7:
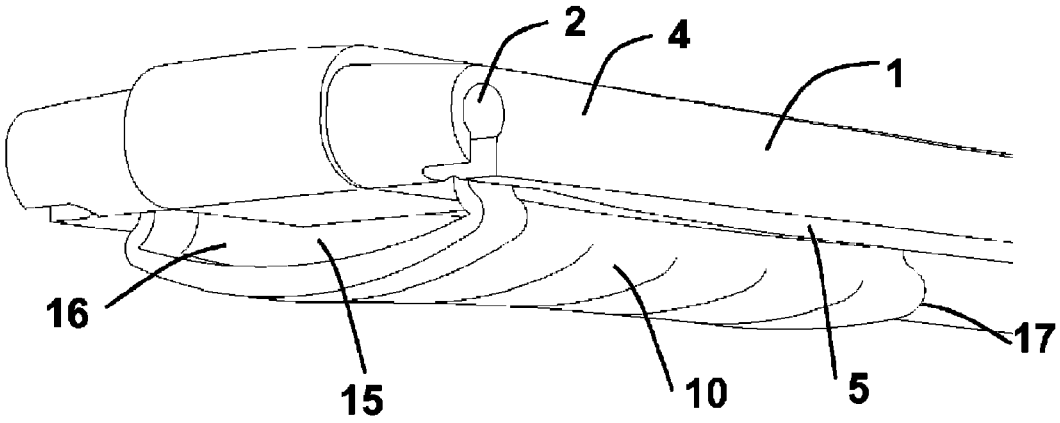
FIG. 7 shows a perspective view of a bracelet strand according to a second embodiment of the invention.

Thus, a first solution that is not shown consists in a longitudinal opening 15 of the comfort pad, opening out toward the outside only at its end 17 oriented toward the clasp of the bracelet, in a manner similar to a blind hole. A second solution consists in a longitudinal opening 15 that is open over its two ends 16, 17. This solution offers the advantage of facilitating cleaning of the strand, as compared to the first solution above. Such a solution is illustrated in FIG. 7.

Finally, it can be seen that the invention may be embodied with a comfort pad 10 having any longitudinal opening 15, preferably but not exclusively extending over the entire length of the comfort pad. Thus, this design of the invention is embodied by a comfort pad 10 added to the inside surface of a bracelet strand, comprising an opening 15 surrounded with shock-absorbing elastic portions 11 designed to come into contact with the wearer's arm. Preferably, the section of the comfort pad has a form that is constant or similar over all or the greater part of the length thereof, preferably at least three fourths of the length thereof. The thicknesses of materials and the forms of the component parts of the comfort pad may vary over the length of the comfort pad.

The invention claimed is:

1. A bracelet strand for a wristwatch, comprising
- a first end suitable for a connection to a watchcase, and
- an elastically deformable comfort pad arranged on an inside surface of the bracelet strand close to the first end,
- wherein the comfort pad comprises a longitudinal opening along a longitudinal direction of the bracelet strand,
- wherein the comfort pad comprises, in a transverse section of the comfort pad, the longitudinal opening in a central part of the transverse section, surrounded on either side by at least one elastically deformable part,
- wherein, in the transverse section, the elastically deformable parts comprise at least two inclined branches, being at least one planar or rounded, having an inclined approximately V- or U-shape,
- wherein the at least two inclined branches are oriented toward the inside from the inside surface of the bracelet strand.

2. The bracelet strand for a wristwatch according to claim 1, wherein the strand extends transversely beyond the elastically deformable parts on this section of the strand.

3. The bracelet strand for a wristwatch as claimed in claim 1, wherein, in each of the elastically deformable parts, a first branch portion extends transversally to the longitudinal direction from the inside surface of the strand in accordance with an inclination $\alpha$ at rest of between 5 and 45 degrees relative to this surface, and a second branch portion extends transversally to the longitudinal direction with an inclination $\beta$ at rest of between 0 and 45 degrees relative to this surface.

4. The bracelet strand for a wristwatch as claimed in claim 1, wherein the elastically deformable parts are arranged symmetrically around the longitudinal and central opening.

5. The bracelet strand for a wristwatch as claimed in claim 1, wherein the upper ends of the elastically deformable parts are spaced by a distance that delimits an open upper end of the longitudinal opening.

6. The bracelet strand for a wristwatch as claimed in claim 1, wherein the elastically deformable parts extend longitudinally over the entire length of the comfort pad.

7. The bracelet strand for a wristwatch as claimed in claim 6, wherein each of the elastically deformable parts is continuous.

8. The bracelet strand for a wristwatch as claimed in claim 6, wherein the longitudinal opening extends longitudinally over the entire length of the comfort pad.

9. The bracelet strand for a wristwatch as claimed in claim 1, wherein the strand comprises lateral edges placed around the comfort pad.

10. The bracelet strand for a wristwatch as claimed in claim 1, wherein the comfort pad extends over at least one fourth of the total length of the strand.

11. The bracelet strand for a wristwatch as claimed in claim 10, wherein the comfort pad extends on less than half the total length of the strand.

12. The bracelet strand for a wristwatch as claimed in claim 1, which is made from elastomeric, plastic or rubber material, and wherein the comfort pad forms a single piece molded with the bracelet strand.

13. A bracelet for a wristwatch, which comprises two strands as claimed in claim 1.

14. A wristwatch, which comprises a bracelet as claimed in claim 13.

15. The bracelet strand for a wristwatch as claimed in claim 6, wherein the elastically deformable parts have interruptions arranged in the longitudinal direction in order to increase the flexibility of the bracelet strand.

* * * * *